US008463585B2

(12) United States Patent
Sun et al.

(10) Patent No.: US 8,463,585 B2
(45) Date of Patent: Jun. 11, 2013

(54) APPARATUS AND METHOD FOR MODELING WELL DESIGNS AND WELL PERFORMANCE

(75) Inventors: Kai Sun, Missouri City, TX (US); Jesse Constantine, Kingwood, TX (US); Craig Coull, Hundvag (NO)

(73) Assignee: Baker Hughes Incorporated, Houston, TX (US)

( * ) Notice: Subject to any disclaimer, the term of this patent is extended or adjusted under 35 U.S.C. 154(b) by 558 days.

(21) Appl. No.: 12/470,869

(22) Filed: May 22, 2009

(65) Prior Publication Data

US 2010/0299124 A1 Nov. 25, 2010

(51) Int. Cl.
*G06G 7/48* (2006.01)

(52) U.S. Cl.
USPC ..... 703/10; 166/311; 166/378; 166/278; 166/297; 166/250.01; 73/53.01; 73/861.04

(58) Field of Classification Search
USPC ..... 703/10; 702/13, 12; 166/250.01, 166/250.16
See application file for complete search history.

(56) References Cited

U.S. PATENT DOCUMENTS

| | | | | |
|---|---|---|---|---|
| 4,442,710 | A | 4/1984 | Meng | |
| 4,803,873 | A | 2/1989 | Ehlig-Economides | |
| 7,725,301 | B2 * | 5/2010 | Shah et al. | 703/10 |
| 2005/0149307 | A1 * | 7/2005 | Gurpinar et al. | 703/10 |
| 2005/0194131 | A1 | 9/2005 | Tseytlin | |
| 2007/0112547 | A1 * | 5/2007 | Ghorayeb et al. | 703/10 |
| 2008/0234939 | A1 * | 9/2008 | Foot et al. | 702/12 |

OTHER PUBLICATIONS

Sun et al.; "Interaction Between Intelligent Well Applications and Reservoir Management—A comprehensive thermal modeling technology for IWS well," SPE 115102, 2008 SPE Annual Technical Conference and Exhibition, Denver, Colorado, Sep. 21-24, 2008, pp. 1-15.

Mohajer; "Utilizing Online Water Detection to Automate Production Management," SPE-118075-PP, 2008 Abu Dhabi International Petroleum Exhibition and Conference, Nov. 3-6, 2008, pp. 1-4.

* cited by examiner

*Primary Examiner* — Saif Alhija
*Assistant Examiner* — Cuong Luu
(74) *Attorney, Agent, or Firm* — Cantor Colburn LLP

(57) ABSTRACT

In one aspect, a method of estimating fluid flow contribution from each producing zone of multi-zone production well is provided, which method may include: defining a wellhead pressure; determining a first inflow performance relation (IPR1) between pressure and fluid inflow rate at a first producing zone and a second inflow performance relation (IPR2) between pressure and fluid inflow rate at a second producing zone; determining a combined performance relation (IPRc) between pressure and fluid inflow rate at a commingle point; defining an initial fluid flow rate into the well from the first zone and an initial fluid flow rate from the second zone; generating a first fluid lift performance relation (TPR1) between pressure and total fluid flow corresponding to the commingle point using the initial fluid flow rates from the first and second production zones and at least one fluid property; and determining contribution of the fluid from the first zone and the second zone at the commingle point using IPRc and TPR1.

20 Claims, 6 Drawing Sheets

APPARATUS AND METHOD FOR MODELING WELL DESIGNS AND WELL PERFORMANCE

BACKGROUND OF THE DISCLOSURE

1. Field of the Disclosure

This disclosure relates generally to well design, modeling well performance and well monitoring.

2. Background of the Art

Wellbores are drilled in subsurface formations for the production of hydrocarbons (oil and gas). Some such wells are vertical or near vertical wells that penetrate more than one reservoir or production zone. Inclined and horizontals wells also have become common, wherein the well traverses the production zone substantially horizontally, i.e., substantially along the length of the reservoir. Many wells produce hydrocarbons from two or more (multiple) production zones (also referred to as "reservoirs"). Inflow control valves are installed in the well to control the flow of the fluid from each production zone. In such multi-zone wells (production wells or injection wells) fluid from different production zones is commingled at one or more points in the well fluid flow path. The commingled fluid flows to the surface wellhead via a tubing. The flow of the fluids to the surface depends upon: properties or characteristics of the formation (such as permeability, formation pressure and temperature, etc.); fluid flow path configurations and equipment therein (such as tubing size, annulus used for flowing the fluid, gravel pack, choke and valves, temperature and pressure profiles in the wellbore, etc.). It is often desirable to simulate the fluid contributions from each production zone in a multi-zone production well before designing and completing such wells. The industry's available analysis methods and models often do not take into account some of the above-noted properties when determining the contributions of the fluids by different zones. The disclosure herein provides an improved method and model for determining the contributions of the fluid from each zone in a multi-zone production well.

SUMMARY OF THE DISCLOSURE

In one aspect, a method of estimating fluid flow contribution from each production zone of a multi-zone production well is provided. In one embodiment, the method may include: defining a wellhead pressure; determining a first integrated inflow performance relation (IPR1) between pressure and fluid inflow from a first production zone and a second integrated inflow performance relation (IPR2) between pressure and fluid inflow from a second production zone; determining an integrated inflow performance relation (IPRc) at a commingle point using IPR1 and IPR2; defining an initial fluid contribution from the first production zone and an initial fluid contribution from the second production zone into the commingle point; determining a first total outflow performance relation between pressure and total flow (TPR1) for fluid flow from the commingle point to an uphole location; and determining a first fluid contribution from the first production zone (Q11) and a first fluid contribution from the second production zone (Q21) to the commingle point using the IPRc and TPR1.

Examples of the more important features of for determining contributions from each zone of a multi-zone production well system have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the system and methods for monitoring and controlling production wells described and claimed herein, reference should be made to the accompanying drawings and the following detailed description of the drawings wherein like elements generally have been given like numerals, and wherein:

DETAILED DESCRIPTION OF THE DRAWINGS

Figure 1:
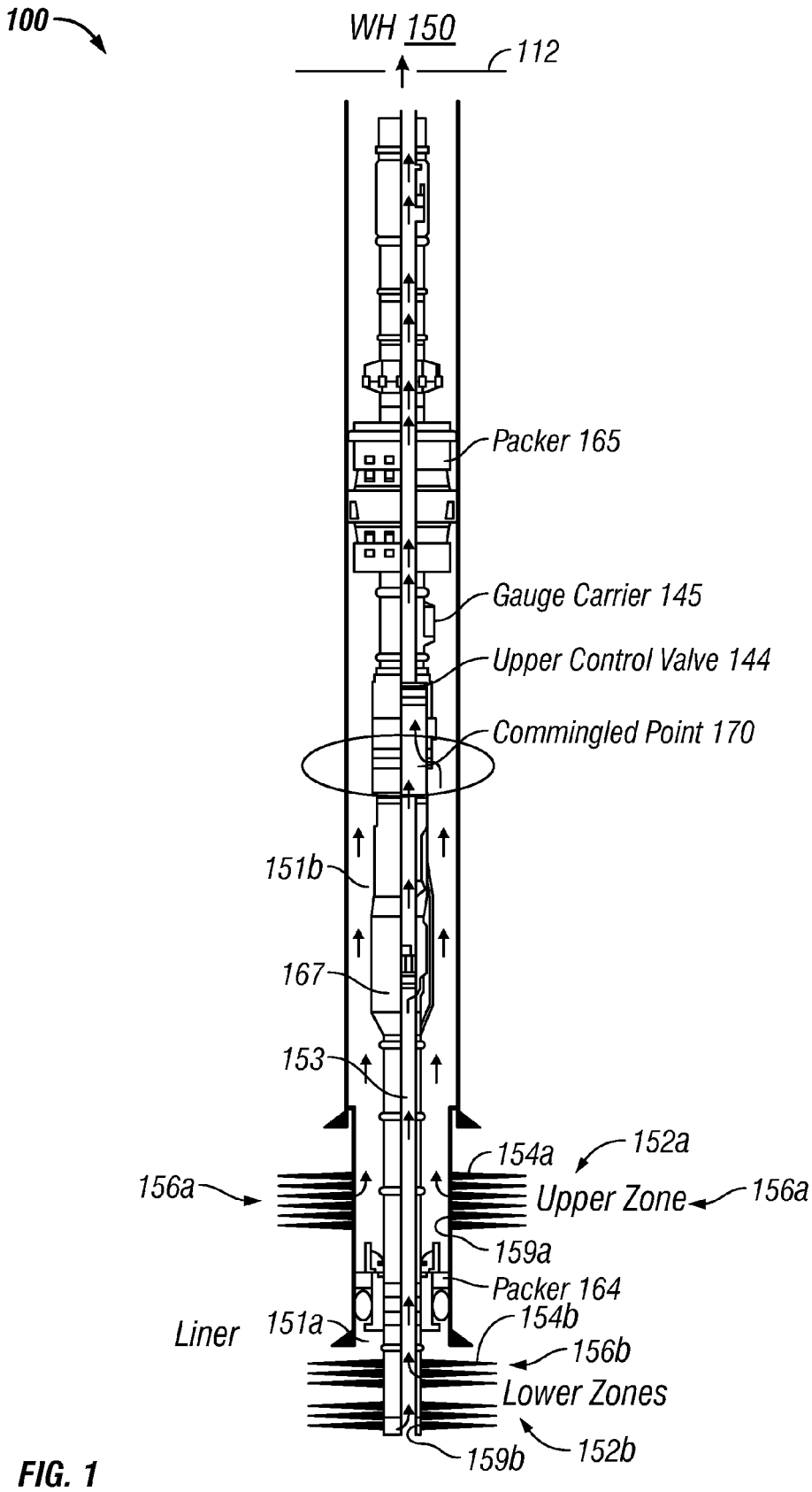
FIG. 1 is a schematic diagram of an exemplary multi-zone production well system configured to produce fluid from multiple production zones, according to one embodiment.

FIGS. 1 is a schematic diagram of an exemplary a multi-zone production well system 100. The system 100 is shown to include a well 160 drilled in a formation 155 that produces formation fluid 156*a* and 156*b* from two exemplary production zones 152*a* (upper production zone or reservoir) and production zone 152*b* (lower production zone or reservoir) respectively. The well 160 is shown lined with a casing 157 containing perforations 154*a* adjacent the upper production zone 152*a* and perforations 154*b* adjacent the lower production zone 152*b*. A packer 164, which may be a retrievable packer, positioned above or uphole of the lower production zone perforations 154*a* isolates fluid flowing from the lower production zone 152*b* from the fluid flowing from the upper production zone 152*a*. A sand screen 159*b* adjacent the perforations 154*b* may be installed to prevent or inhibit solids, such as sand, from entering into the well 160 from the lower production zone 154*b*. Similarly, a sand screen 159*a* may be used adjacent the upper production zone perforations 159*a* to prevent or inhibit solids from entering into the well 150 from the upper production zone 152*a*.

The formation fluid 156*b* from the lower production zone 152*b* enters the annulus 151*a* of the well 150 through the perforations 154*b* and into a tubing 153 via a flow control device 167. The flow control valve 167 may be a remotely-controlled sliding sleeve valve or any other suitable valve or choke configured to regulate the flow of the fluid from the annulus 151*a* into the production tubing 153. The formation fluid 156*a* from the upper production zone 152*a* enters the annulus 151*b* (the annulus above the packer 164*a*) via perforations 154*a*. The formation fluid 156*a* enters into the tubing 153 at a location 170, referred to herein as the commingle point. The fluids 156*a* and 156*b* commingle at the commingle point. An adjustable fluid flow control device 144 (upper control valve) associated with the line 153 above the commingle point 170 may be used to regulate the fluid flow from the commingle point 170 to the wellhead 150. A packer 165 above the commingle point 170 prevents the fluid in the annulus 151*b* from flowing to the surface. A wellhead 150 at the surface controls the pressure of the outgoing fluid at a desired level. Various sensors 145 may be deployed in the system 100 for providing information about a number of downhole parameters of interest.

Figure 2:
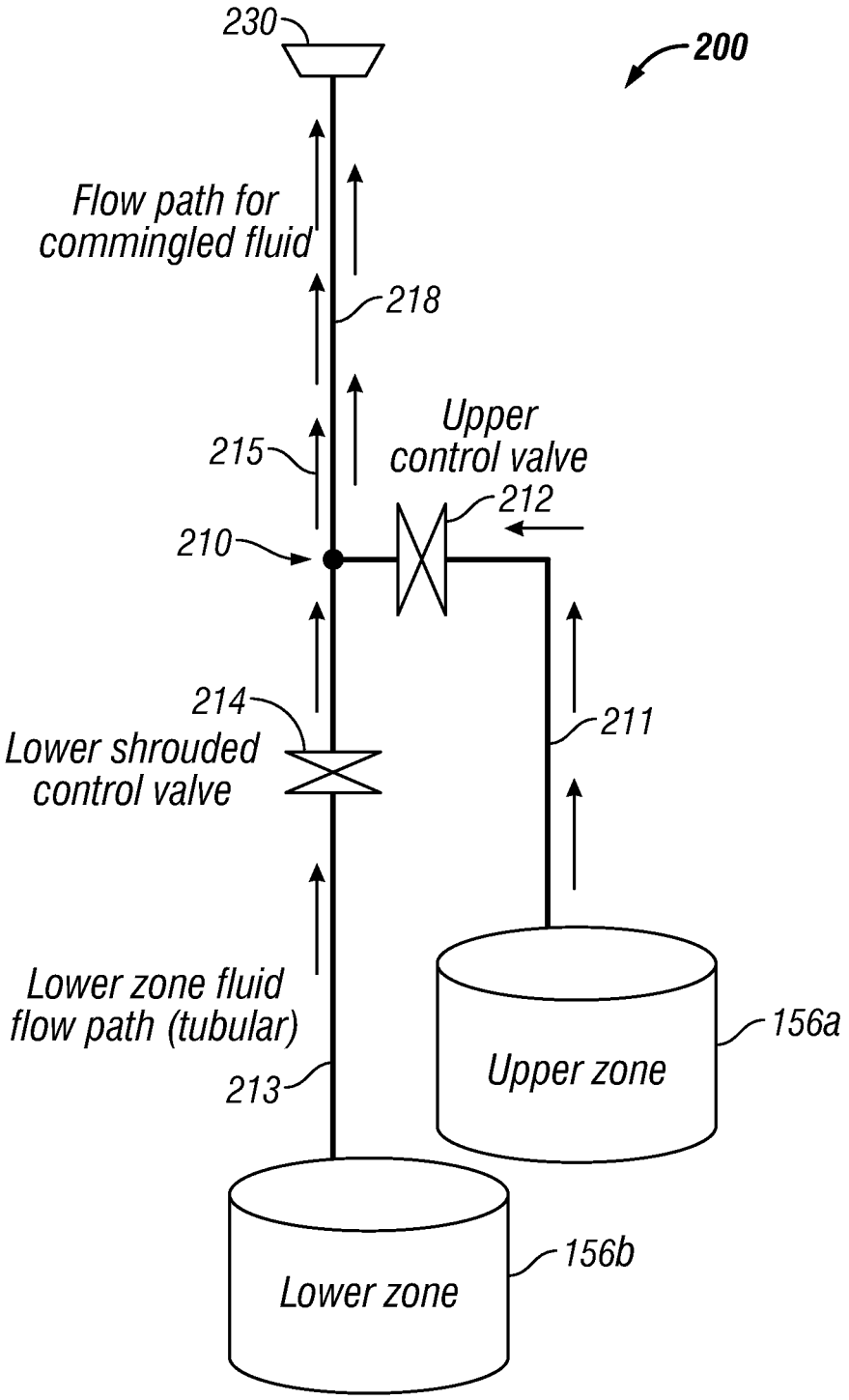
FIG. 2 is a functional diagram showing commingling of fluids from different production zones of the well system shown in FIG. 1.

FIG. 2 is a functional diagram 200 showing the flow of the fluid 156*a* from the upper production zone 152*a* and the flow of the fluid 156*b* from the lower production zone 152*b* shown in FIG. 1. The fluid 156*a* from the upper production zone or the first reservoir 152*a* flows to a commingle point 210 via an annulus (which also may include a fluid line) 211 and a flow control valve or choke 212. The flow control valve 212 may be set at any number of settings, each setting defining a percentage opening of the flow control valve 212. The fluid 156*b* from the lower production zone or the second reservoir 156*b* flows to the commingle point 210 via a flow line 213 and a flow control valve 214, which may be set at any number of openings. The commingled fluid 215 from the commingle point 210 flows to a wellhead 230 via a tubing system 218.

Figure 3:
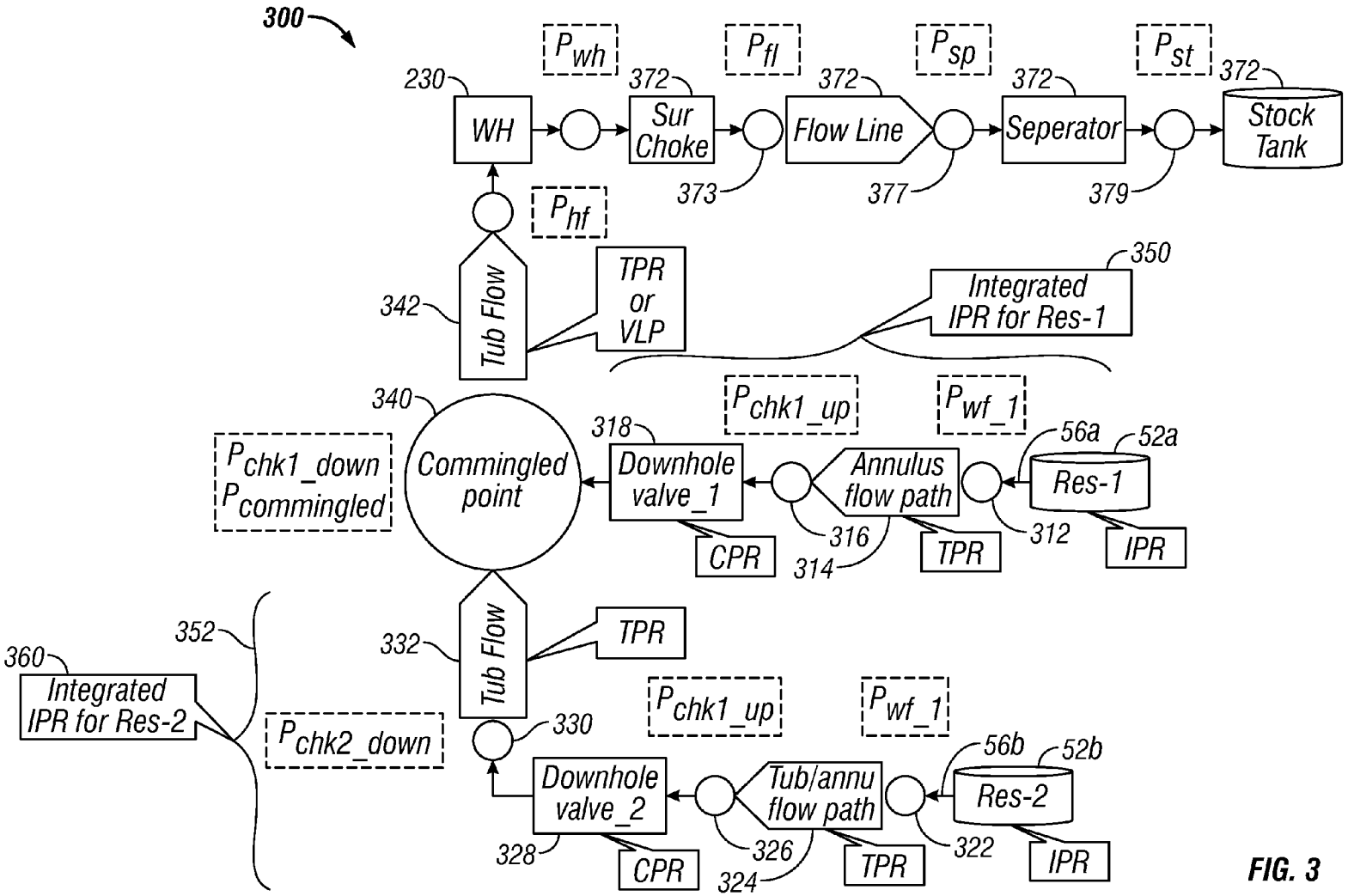
FIG. 3 is a functional diagram showing nodes in the flow path of fluids from each production to a commingle point and the nodes from the commingle point to the surface, in an exemplary multi-zone production well system, such as the well system shown in FIG. 2.

FIG. 3 is a functional diagram 300 showing exemplary nodes in the fluid flow paths for the fluid flowing from each of the production zones to the wellhead 230 and then to a storage facility 380. Formation fluid 156*a* from the upper production zone or the first reservoir (Res-1) 152*a* flows through a sand screen into a first node 312 in the well and travels uphole through an annulus flow path 314 to a second node 316 before entering a downhole valve or choke 318. In one aspect, the node 312 in the well may be chosen as the center of the perforations 159*a* (FIG. 1) or any other suitable point in the well. The second node 216 may be a point proximate a location where the fluid enters the valve 318. The fluid from the valve 316 then discharges into a commingle point 340 where the fluid 156*a* commingles with the fluid 156*b* from the lower production zone 152*b*. The pressure at the node 312 is the downhole well pressure and is designated as Pwf_1 and the pressure at the node 316 (after the annulus flow path 314 and before the choke 318 is designated as Pchk1-up. The pressure Pc at the commingle point 340 is the same as the pressure Pchk1_dn after the valve 318. Formation fluid 156*b* from the second production zone or reservoir (Res-2) 152*b* flows through a sand screen into a first node 322 in the well and travels uphole through a tubing flow path 324 to a second node 326 before entering a downhole valve or choke 328. The pressure Pwf_2 at node 322 is the pressure in the wellbore adjacent the perforations at the lower production zone 152*a*. In one aspect, the node 322 in the well may be chosen as the center of the perforations 159*b*. Any other suitable point in the well may also be chosen. The second node 326 may be a point where the fluid 156*b* enters the valve 328. The fluid from the valve 228 discharges into a third node 330 and, then, after flowing through a tubing 232, commingles with the fluid 152*a* from the first production zone 152*a* at the commingle point 340. The pressure at the node 322 is the downhole pressure in the well and is designated as Pwf_2, the pressure at the node 326 is designated as Pchk2_up, the pressure at the node 330 is designated as Pchk-2_down, and the pressure at the commingle point is designated as Pchk1_down or Pc. The commingled fluid from the commingle node 340 flows to the wellhead 370 via a tubing system 342. A surface valve or choke 372 may be used to control the fluid flow from the well to the surface. The pressure at the wellhead 370 is controllable and is designated as Pwh. The fluid from the surface choke 372 flows to a storage tank 380 via a flow line 376 and a separator (gas/oil/water separator) 378. The pressure at the node 373 between the surface choke 372 and the flow line 376 is designated as Pf1, the pressure at the node 377 between the flow line 376 and the separator 378 as Psp and the pressure at node 379 between the separator 378 and the storage tank 380 as Pst. FIGS. 2 and 3 show flow diagrams for a two production zone well system. The methods described herein equally apply to well systems containing more than two production zones.

In one aspect, to determine the fluid contributions from each production zone, the pressure Pc at the commingle point 320 may be used as a control point, as described in more detail below with respect to FIGS. 4 and 5. Any suitable method for determining the commingle point 320 may be utilized for the purpose of this disclosure, including the method described below. Typically, the reservoir pressure is known from historical information or from prior wells drilled in the same formation. The pressure Pwf_1 at node 312 is the wellbore pressure. When Pwf_1 is greater or equal to the reservoir pressure, no fluid flows into the well 150. For a first selected Pwf-1 value (lower than the formation pressure Pres_1, the fluid flow or mass flow Q1 corresponding to reservoir 152*a* may be calculated using the relation Q1=PI[Pres_1−Pwf_1], where PI is a known performance index for the fluid path and Pres_1 may be obtained from prior data. The pressure Pch1k_up may be calculated from the relation Pchk1_up=Pwf_1−Q1/PI, wherein Pwf_1 and Q1 are known from the above-noted calculation. Similarly a pressure Pc at the commingle point may be calculated using the known value of Q1 and the above calculated pressure Pchk_1 as the input pressure. Thus, for any selected wellhead pressure and settings of the chokes in a fluid flow path, pressure Pc at the commingle point may be computed using the above method. Therefore for each wellhead pressure value, there is value for Pc and Q for each production zone.

It is desirable to simulate or model the fluid flow behavior of a multi-zone production well system before designing and completing such a well system. The disclosure herein, in one aspect, provides a method for numerically modeling or simulating the fluid flow behavior for each production zone for a given well configuration. The simulation model, in one aspect, utilizes a thermal modeling or enthalpy technique for simulating or modeling the flow behavior of fluids flowing through divided flow paths, such as fluid paths shown in FIG. 2. In one aspect, the pressure, volume and temperature (p-v-t) behavior of each reservoir is used in the modeling method herein. Formation properties, such as pressure, temperature, permeability, fluid density, fluid viscosity, etc. differ from one well to another. Any suitable method may be utilized for determining the p-v-t behavior of the reservoir to be modeled, including but not limited to the method known as "oil system correlations." such as Standing correlations, Lasater correlation, Vasquez and Beggs correlations, etc. and z-factor correlation, such as Brill and Beggs z-factor correlation, or Hall and Yarborough z-factor correlation. The fluid flow in the well is often a multiphase flow and may contain gas, especially when the pressure in the well is below the bubble point. Directly solving for a multiphase flow for a complex well profile, such as the well profile shown in the system of FIG. 2, may be time consuming. The disclosure herein, in one aspect, provides a nodal analysis method, referred to herein as the "integrated inflow performance relationship (IPR) method", to determine the fluid flow contribution from each production zone in a multi-zone well system. This method, in one aspect, is based on the assumption of pressure-system balance, i.e., the pressure at the commingled point 340 (FIG. 3) is balanced at a steady-state flow condition. This assumption allows integration of the inflow performance relationship of the fluid entering from a particular production zone with the performance of flow paths and performance of flow control and other devices in the flow path to generate integrated pressure versus flow-rate (or mass-rate) relationships corresponding to the commingle point 340. An outflow curve (also referred to in the industry as the "lift curve" and as tubing performance relation ("TPR" herein")) for the fluid from the commingle point or an upper control valve to the wellhead may be generated using a suitable single/multiphase tubing performance relationship (TPR) model, including, but not limited to, the modified Hagedorn-Brown model. A lift curve provides a relation between pressure at a selected point and the total flow or mass rate. The well production rate, zonal production allocations, and wellbore pressure profile may be predicted using the integrated IPRs and the lift curve corresponding to the commingle point as the solution node.

Figure 4:
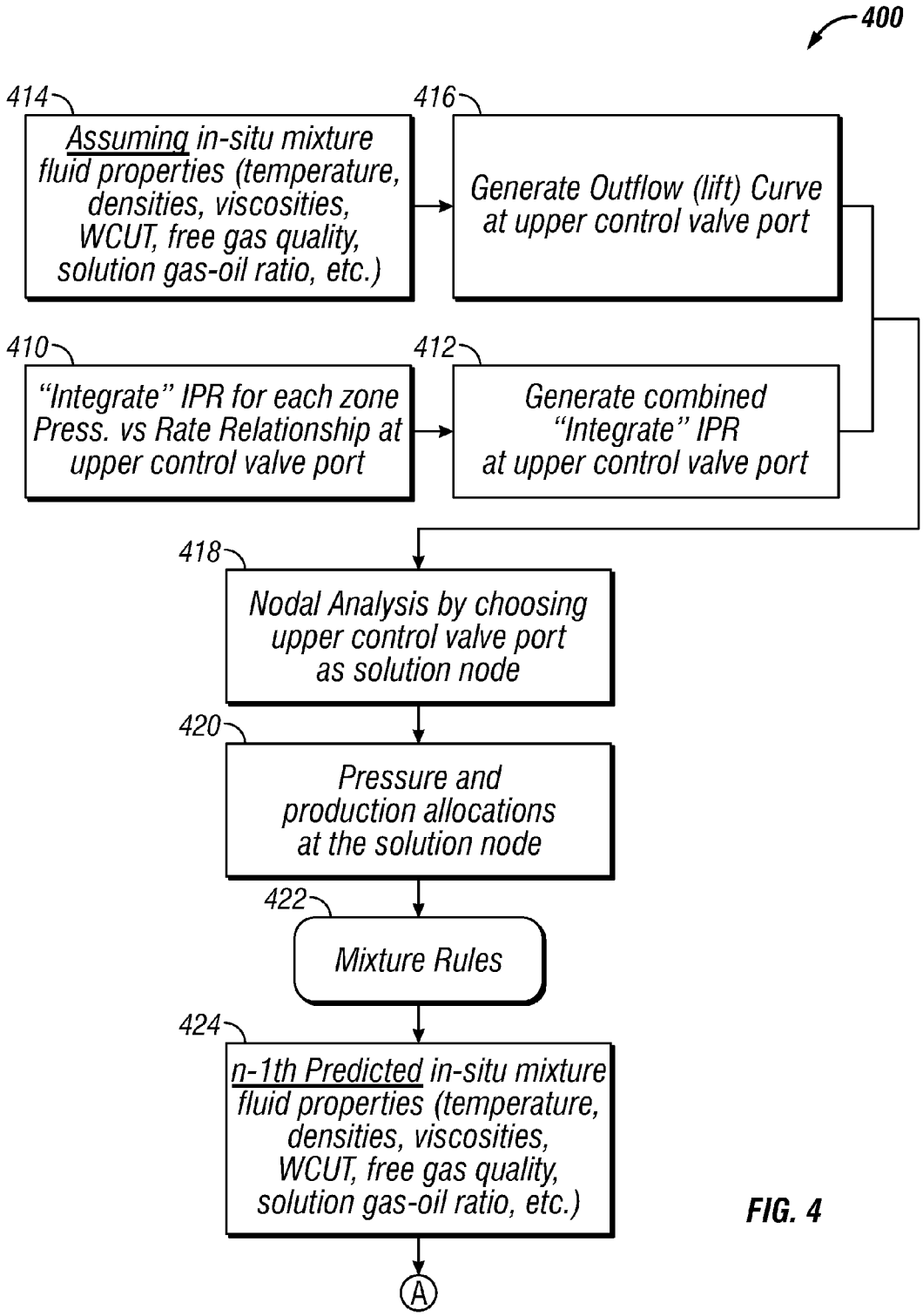
FIG. 4 is a flow chart showing a method for determining fluid contribution from each production zone in a multi-zone production well, such as shown in FIG. 3.
Figure 4:
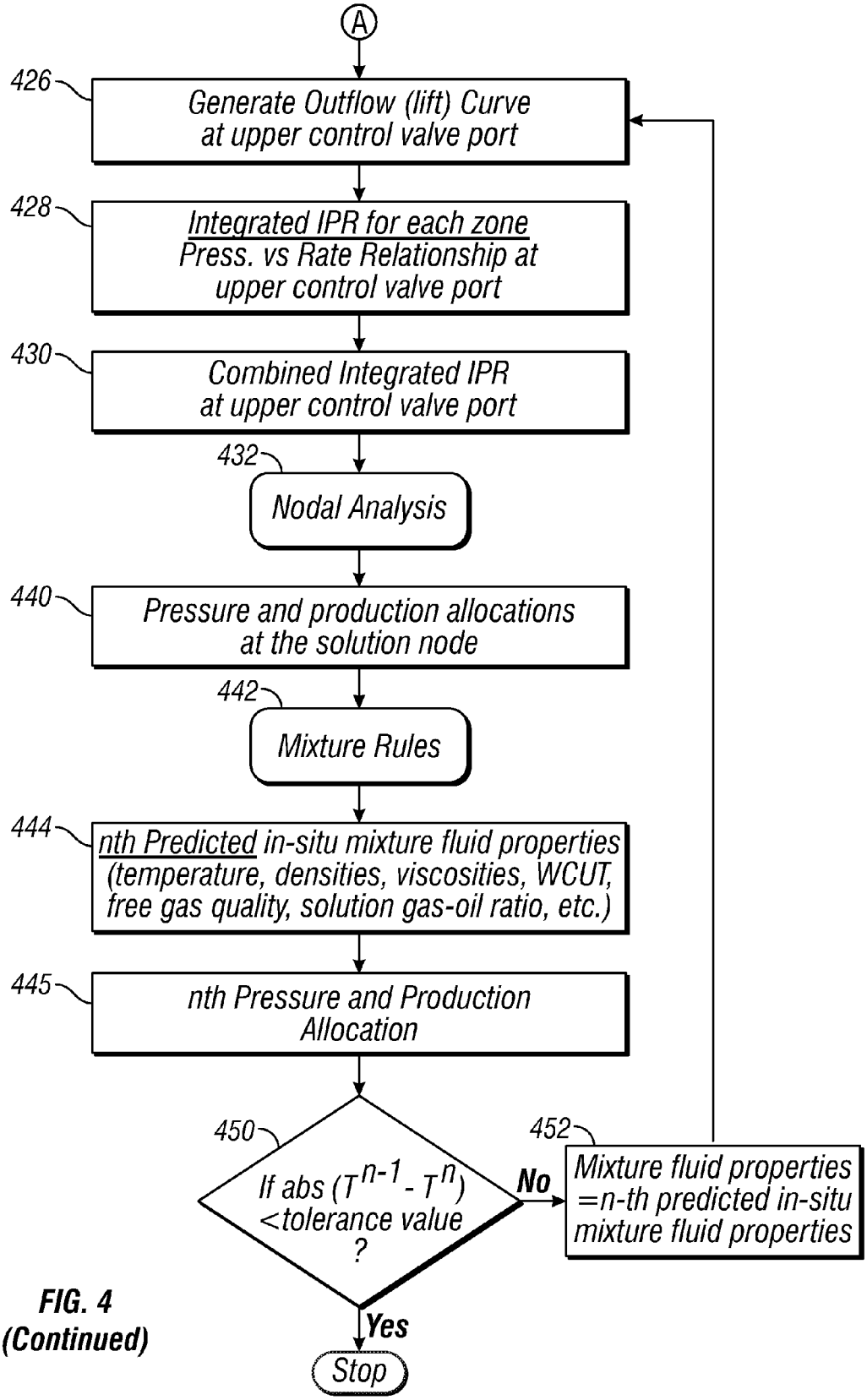
Figure 5:
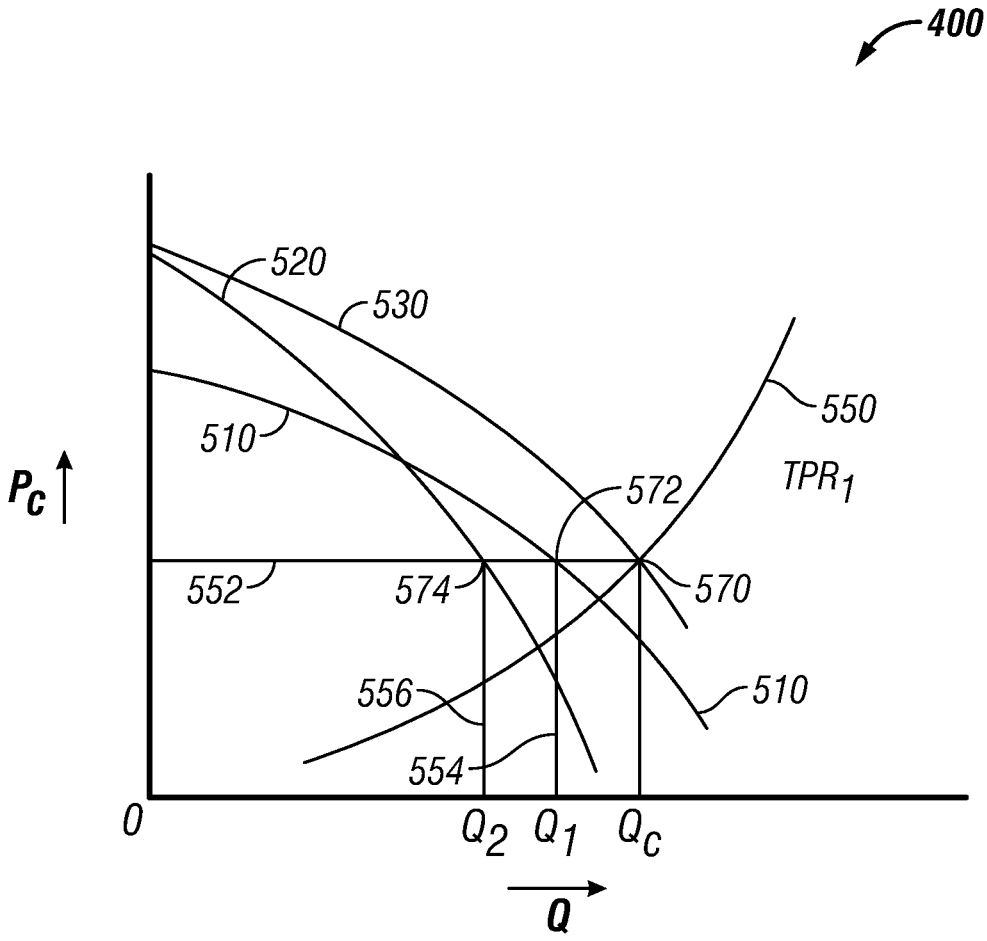
FIG. 5 shows plots of exemplary pressure versus flow rate or mass rate that may be utilized in the method shown in FIG. 4.

FIG. 4 shows a flow diagram of an iterative process 400 that may be utilized for determining the fluid contributions (zonal production allocations) for an exemplary two-zone production well system, such as the system shown in FIGS. 2 and 3. In the process 400, an integrated inflow performance relation (IPR) (i.e., relation between pressure and flow rate) is obtained for a selected well head pressure for each production zone (Block 410). In one aspect, an integrated IPR accounts for the IPR for various flow control devices and tubings in the flow path of the fluid up to the commingle point 340. For example, the integrated IPR 350 for the fluid flow path 352 corresponding to first reservoir 152*a* accounts for the IPR for the annulus path 314 and downhole valve 318 (FIG. 3). Similarly, the integrated IPR 360 for the second reservoir flow path 362 accounts for the IPR for the tubing flow path 324 and the downhole valve 328 (FIG. 3). FIG. 5 shows a graph of the pressure Pc and flow rate relation relating to the system shown in FIG. 3. Referring now to FIGS. 3-5, the pressure Pc at the commingle point is shown along the vertical axis and the flow rate Q is shown along the horizontal axis. Plot 510 is an exemplary integrated IPR corresponding to the flow path 352 and plot 520 is an exemplary integrated IPR corresponding to the flow path 362. The integrated IPR's 510 and 520 from such production zones may be combined to obtain an integrated IPR for the combined flow (IPRC) corresponding to the commingle point 340. Plot 530 shows the combined integrated inflow performance relation IPRC for the exemplary system shown in FIG. 3 [Block 412]. Another input used for the nodal analysis herein is a tubing lift curve for the flow of the commingled fluid. A lift curve is a relation between pressure and fluid or mass flow. To calculate the values for the lift curve, the in-situ fluid properties (i.e., temperature, density, viscosity, solution gas-oil ratio, water cut, etc.) of the mixture produced from each production zone may be assumed based on prior knowledge [Block 414]. A lift curve based on such assumed values may then be generated corresponding to the commingle point (or upper control valve) using any suitable model, such as Hagedorn-Brown method, Orkiszewski method, Aziz method, etc. [Block 416]. Plot 550 shows an exemplary lift curve corresponding to the commingle point 340 for a two production zone system shown in FIG. 3.

The fluid contribution by each production zone may then be determined (first iteration) using a nodal analysis corresponding to the commingle point or the upper control valve [Block 418]. The contributions may be determined using the lift curve 550 and the combined integrated performance relation corresponding to the commingle point IPRc 530 as described below. The cross point 570 defines the pressure and the total or combined fluid flow Qc corresponding to the commingle point 340 based on the initially selected or assumed wellhead pressure and the initially assumed contributions from each of the production zones. Typically the initially assumed contributions may be, for example, 50% from each production zone or values estimated based on the setting of the valves corresponding to each production zone. The cross point between the pressure line 552 corresponding the commingle point pressure and the integrated IPR 510 of the first production zone defines the contribution Q11 from the first production zone 152*a*. Similarly, the cross point 574 between the pressure line 552 and the integrated IPR for the second production zone defines the contribution Q21 from the second production zone 152*b*. Block 420 shows the pressure P1 and production allocations Q11 and Q21 after the first iteration at the solution node (commingle point). Temperature at the commingle point or the solution point is often considered among the most sensitive parameters. In one aspect, the model herein uses the temperature at the commingle point as a control parameter to predict the contributions from different production zones. The temperature T1 at the commingle point, in on aspect, may be determined using any suitable thermal model, such as Hasan-Kabir method, etc.

The production allocations Q11 and Q21 (mixture rules) [Block 422] and the in-situ mixture fluid properties (temperature, densities, viscosities, free gas, WCUT, free gas quality, gas-oil ratio, etc.) corresponding to the mixture Q1 and Q2 (n-1$^{th}$ values) [Block 422] may then be used to obtain an n-1$^{th}$ fluid lift curve [Block 426]. Using the n-1$^{th}$ lift curve and the previously computed integrated IPR curves 510 and 520 (FIG. 5) [Block 428], the computed combined integrated IPRc [Block 430] and performing the above described nodal analysis [Block 432] the n-1$^{th}$ pressure and fluid contribution values and pressure c from the first production zone (Q12) and the second production zone (Q22) are then determined along with the temperature Tn-1 at the commingle point [Block 440]. This iterative process may be continued to obtain the n$^{th}$ pressure and fluid contributions from each of the production zone along with the temperature Tn. lift curve and the nth fluid contributions [Blocks 442, 444 and 445].

The above described iterative process may be continued until the difference between the temperature at the commingle point between successive iterations is within a selected limit or a tolerance value [Block 450]. If not, further iterations may be performed [Block 452]. For example, when the temperature difference between the temperature computed at the n$^{th}$ iteration and the n-1$^{th}$ iteration is within selected values, the fluid contributions determined after the n$^{th}$ iteration from each production zone may be considered as the resultant values from the nodal model described herein [Block 450]. If the temperature difference is outside the limit, the process may be continued as described above [Block 452]. The final values of the flow contributions from different production zones may then be used for designing a well system or for any other suitable purpose. Although the iterative process described above utilizes integrated IPR values corresponding to each production fluid flow path for determining the contributions from each production zone, any other Inflow performance relation may be utilized for the purpose of this disclosure. Pressure or any other parameter may also be used as the control parameter. It should be noted that the methods described herein are equally applicable to well systems with more than two production zones. For the purpose of this disclosure, any location or point in the flow of commingled flow may be utilized as the solution point, including the commingle point. Also, the terms tubing flow performance relation (TPR), lift curve and outflow curve are used interchangeably.

While the foregoing disclosure is directed to the certain exemplary embodiments and methods, various modifications will be apparent to those skilled in the art. It is intended that all modifications within the scope of the appended claims be embraced by the foregoing disclosure.

What is claimed is:

1. A method of estimating fluid flow contribution from each production zone of a multi-zone production well for a model that is used for designing a multi-zone production well, the method comprising:

(a) defining a wellhead pressure;

(b) providing a model of fluid behavior of each production zone in a multi-zone production well:

(c) determining, using the model, an integrated inflow performance relation (IPR1) between pressure and fluid inflow from a first production zone and an integrated inflow performance relation (IPR2) between pressure and fluid inflow from a second production zone;

(d) determining, using the model, an integrated inflow performance relation (IPRc) at a commingle point using IPR1 and IPR2;

(e) defining an initial fluid contribution from the first production zone and an initial fluid contribution from the second production zone into the commingle point;

(f) determining, by a computer using the model, a first total outflow performance relation between pressure and flow rate (TPR1) for fluid flow from the commingle point to an uphole location, using a tubing performance relationship model; and (g) determining a fluid contribution from each production zone by determining a first fluid contribution from the first production zone (Q11) and a first fluid contribution from the second production zone (Q21) to the commingle point using the IPRc and TPR1 and the model;

wherein at least processes (c), (d) and (g) are iterated until a parameter of interest meets a selected criterion.

2. The method of claim 1 further comprising:

determining a second total outflow performance relation (TPR2) using Q11 and Q21; and determining a second fluid contribution from the first production zone (Q12) and a second fluid contribution from the second production zone (Q22) using the TPR2 and the IPRc.

3. The method of claim 1 further comprising:

continuing to determine a new outflow performance relation using most recently determined fluid contributions from the first production zone and the second production zone; and continuing to determine the fluid contributions from the first production zone and the second production zone using the new outflow performance relation and the IPRc until the parameter of interest meets the selected criterion.

4. The method of claim 3, wherein the parameter of interest is temperature at a selected location in the fluid flow and the selected criterion is that the difference in the temperature between successive determinations of the fluid flow contributions from the first and second production zones is within a selected limit.

5. The method of claim 3, wherein the parameter of interest is pressure at a selected location in the fluid flow and the selected criterion is that the difference in the pressure between successive determinations of fluid contributions from the first and second production zones is within a selected limit.

6. The method of claim 4 further comprising using a thermal model to determine the temperature.

7. The method of claim 1, wherein generating the TPR1 comprises using a model that utilizes at least one parameter selected from: pressure, temperature, fluid density, permeability, viscosity, water cut; gas-oil ratio and free gas quality.

8. The method of claim 1, wherein the initial fluid contribution from the first production zone and the initial fluid contribution from the second production zone into the commingle point corresponds to a setting of a flow control devices corresponding to the first production zone and the second production zones.

9. The method of claim 1, wherein determining the IPR1 comprises determining a plurality of pressures at the commingle point corresponding to a plurality of flow rates from the first production zone into the commingle point based on flow devices between the first production zone and the commingle point.

10. The method of claim 9, wherein the flow devices include at least one of: a choke; a tubing; and an annulus space in the well.

11. A computer program product for estimating fluid flow contribution from each production zone of a multi-zone production well, the computer program product comprising:

a non-transitory computer-readable medium accessible to a processor containing a program that includes instructions to be executed by the processor, the program comprising:

(a) instructions to select a wellhead pressure;

(b) instructions to provide a model of fluid behavior of each production zone in a multi-zone production well:

(c) instructions to determine, using the model, a first integrated inflow performance relation (IPR1) between pressure at a commingle point and fluid inflow from a first production zone and a second integrated inflow performance relation (IPR2) between the pressure at the commingle point and fluid inflow from a second production zone;

(d) instructions to determine, using the model, an integrated inflow performance relation (IPRc) at the commingle point using the IPR1 and IPR2;

(e) instructions to define an initial fluid contribution from each of the first and second production zones into the commingle point;

(f) instructions to generate, using the model, a first total outflow performance relation (TPR1) for the flow path from the commingle point to an uphole location using the defined initial fluid contributions and a tubing performance relationship model; and (g) instructions to determine a fluid contribution from each production zone by determining a first fluid contribution (Q11) from first production zone and a first fluid contribution (Q21) from the second production zone to the commingle point using the IPRc and TPR1 and the model;

wherein at least processes (c), (d) and (g) are iterated until a parameter of interest meets a selected criterion.

12. The computer program product of claim 11 further comprising:

instructions to determine a second total outflow performance relation (TPR2) using Q11 and Q21; and instructions to determine a second fluid contribution (Q12) from the first production zone and a second fluid contribution (Q21) from the second production zone using the TPR2 and the IPRc.

13. The computer program product of claim 11, wherein the program further comprises instructions to continue to determine total outflow performance relations using most recently determined values of fluid contribution from the first and second production zones and fluid contributions from the first and second production zones using the IPRc until the parameter of interest meets the selected criterion.

14. The computer program product of claim 13, wherein the parameter of interest is temperature.

15. The computer program product of claim 14, where the program further includes instructions to determine the temperature at the commingle point using a thermal model.

16. The computer program product of claim 11, wherein the program further includes instructions to generate the TPR1 using a model.

17. The computer program product of claim 16, wherein the model utilizes at least one parameter selected from a group consisting of: pressure, temperature, fluid density, permeability, viscosity, water cut; gas-oil ratio and free gas quality.

18. The computer program product of claim 11, wherein the initial fluid flows into the well from the first and second production zones correspond to settings of valves for the first and second production zones.

19. The computer program product of claim 11, wherein instructions to determine the first integrated inflow performance relation IPR1 comprises instructions to determine a plurality of pressures at the commingle point corresponding to a plurality of flow rates from the first production zone to the commingle point based on flow devices between the first production zone and the commingle point.

20. The computer program product of claim 19, wherein the devices include at least one of: a flow control device; a tubing; and an annulus in the well.

* * * * *